US005791303A

United States Patent [19]

Skripov

[11] Patent Number: 5,791,303

[45] Date of Patent: Aug. 11, 1998

[54] TWO-CYCLE INTERNAL COMBUSTION ENGINE

[76] Inventor: Jury Nikolaevich Skripov, ulitsa Altaiskaya, 33/7, kv. 55, Moscow, Russian Federation

[21] Appl. No.: 765,956

[22] Filed: Jan. 10, 1997

[30] Foreign Application Priority Data

Jul. 13, 1994 [RU] Russian Federation ..... 94026031

[51] Int. Cl.[6] ..... F02B 33/00

[52] U.S. Cl. ..... 123/71 R; 123/65 VB

[58] Field of Search ..... 123/71 R, 74 AC, 123/65 VB

[56] References Cited

U.S. PATENT DOCUMENTS

| | | | |
|---|---|---|---|
| 2,785,667 | 3/1957 | Miller | 123/6 VB |
| 4,185,597 | 1/1980 | Cinquegrani | 123/71 R |
| 4,332,229 | 6/1982 | Schuit | 123/71 R |
| 4,841,921 | 6/1989 | Yang | 123/71 R |
| 5,233,949 | 8/1993 | Rucker | 123/71 R |
| 5,285,752 | 2/1994 | Reed et al. | 123/71 R |
| 5,345,897 | 9/1994 | Linder et al. | 123/65 VB |

FOREIGN PATENT DOCUMENTS

| | | |
|---|---|---|
| 1560745 | 4/1990 | U.S.S.R. . |
| 1467394 | 3/1977 | United Kingdom . |
| 2149006 | 6/1985 | United Kingdom . |

*Primary Examiner*—David A. Okonsky

*Attorney, Agent, or Firm*—Gary M. Nath; Nath & Associates

[57] ABSTRACT

A two-cycle internal combustion engine comprises a cylinder with a piston, the cylinder having a port in which an intake valve is placed for feeding a fuel-air mixture from an intake manifold into an intake chamber. The intake chamber is positioned under the position, is isolated from a crank chamber and communicates with a combustion chamber. The combustion chamber is positioned above the piston and communicates with the intake chamber by means of a by-pass manifold, at the inlet of which an intake valve is placed for feeding a fuel-air mixture. An additional piston is provided which is positioned in the cylinder between the crank chamber and the main piston and is rigidly connected to the main piston. A second intake chamber is positioned between the first intake chamber and the additional piston. The second intake chamber isolated from the first intake chamber by means of a partition and communicates with the intake manifold and with the by-pass manifold.

13 Claims, 4 Drawing Sheets

TWO-CYCLE INTERNAL COMBUSTION ENGINE

FIELD OF THE INVENTION

The present engine relates to internal combustion engines, and more particularly to a two-cycle internal combustion engine.

The invention can be used as an engine for flying vehicles, for automobiles, motorcycles, agricultural machines, diesel locomotives, marine engines.

PRIOR ART

A two-cycle internal combustion engine is known (see, e.g. USSR patent No. 576973, 1977) comprising a cylinder divided by a partition into an explosion chamber and a compression chamber, in each of which pistons secured on one rod move.

In the aforesaid engine the intake port and the exhaust port of the explosion chamber are positioned below the level of the lower edge of the piston when it is in the upper dead center. The combustion chamber communicates with the compression chamber via a by-pass channel.

During operation the fuel-air mixture, preliminarily compressed in a subpiston chamber of the compression part, enters a subpiston cavity of the explosion part at the moment the pistons pass through the lower dead center. Wherein, the combustion chamber is scavenged. The exhaust gases are passed into an additional secondary combustion chamber positioned to the side of the main combustion chamber. The exhaust gases are by-passed at that moment into a secondary combustion chamber. When the piston moves towards the upper dead center the air compressed in the above-piston cavity of the compression part enters the subpiston cavity of the explosion part via the by-pass channel, and from there into the secondary combustion chamber. Here the exhaust gases are enriched with air oxygen for more complete secondary combustion.

This two-cycle internal combustion engine has a complex construction. The plurality of chambers makes servicing difficult. The presence of an additional secondary combustion chamber does not make it possible to obtain full combustion of the fuel mixture, and therefore the ecological characteristics of the engine are low.

The efficiency of this engine is low since only a small amount of fuel mixture is fed into the combustion chamber. The engine has a short service life.

A two-cycle internal combustion engine is known comprising a cylinder with a piston, the cylinder having a port in which an intake valve is placed for feeding a fuel-air mixture from an intake manifold into an intake chamber which is positioned under the piston, is isolated from the crank chamber and communicates with a combustion chamber positioned above the piston by means of a by-pass manifold, with an intake valve placed at the inlet thereof for feeding the fuel-air mixture from the intake chamber into the combustion chamber, and a window for discharging exhaust gases from the combustion chamber, the window positioned on the wall of the cylinder (see, e.g. USSR patent No. 1697594 A3).

In this engine the by-pass manifold has an expansion which forms a high pressure chamber which is periodically connected via a reverse valve and by-pass windows to the intake and combustion chambers. And a channel is made in the piston for periodically connecting the combustion chamber through a window to the high pressure chamber.

Furthermore, a second channel is made in the piston to connect the combustion chamber to the exhaust port.

When the piston moves downwards, the fuel mixture in the intake chamber is compressed and is force fed into the combustion chamber. In the lower dead center the exhaust window in the side wall of the cylinder opens and the exhaust gases above the piston exit from the combustion chamber. During the upward stroke the piston compresses the remaining gases and draws a fresh mixture into the intake chamber. In the upper dead center the channel in the piston is connected to the high pressure chamber and the compressed hot mixture is fed through that channel into the combustion chamber. At that moment the mixture is ignited.

The fuel mixture in the high pressure chamber is compressed and is released into the combustion chamber at the moment of explosion with the piston in the upper dead center.

The efficiency of this engine is low since the amount of fuel mixture fed into the combustion chamber is very small. This internal combustion engine has a small specific power. The lubrication system is made in a conventional manner which makes servicing more difficult and reduces service life. The exhaust gases contain a large percent of partially combusted fuel mixture which has a negative effect on its ecological characteristics.

DISCLOSURE OF THE INVENTION

The object of the present invention is to create a two-cycle internal combustion engine in which a change in the construction of the intake chamber would make it possible to increase the total volume of the fuel mixture fed into the combustion chamber without changing its volume, to increase the specific power of the engine and to improve the lubrication system, which in turn would promote an increase in the service life of the engine, enhancement of its ecological characteristics and simplification of servicing.

This object is achieved in a two-cycle internal combustion engine comprising a cylinder with a piston, the cylinder having a port in which an intake valve is placed for feeding a fuel-air mixture from an intake manifold into an intake chamber which is positioned under the piston, is isolated from a crank chamber and communicates with a combustion chamber positioned above the piston by means of a by-pass manifold, with an intake valve placed at the inlet thereof for feeding the fuel-air mixture from the intake chamber into the combustion chamber, and a window for discharging exhaust gases from the combustion chamber, the window being positioned on the wall of the cylinder, in that in accordance with the invention, the engine comprises an additional piston arranged in the cylinder between the crank chamber and the main piston and rigidly connected to the main piston, a second intake chamber which is positioned between the first intake chamber and the additional piston, is isolated from the first intake chamber by means of a partition and communicates with the intake manifold by means of a valve mounted in a port in the partition at the inlet to the second intake chamber and facing with its input the intake manifold, and communicates with a by-pass manifold by means of a valve mounted in a port in the partition at the outlet from the second intake chamber and facing with its input the second intake chamber, and a valve mounted in the by-pass manifold at the inlet to the combustion chamber and facing with its input the first and second intake chambers.

It is advisable that the by-pass manifold be made in the form of a channel in the wall of the cylinder and in the head of the cylinder, one end of which channel would communicate with the combustion chamber via a port made in the head of the cylinder, the other end communicating with the first and second intake chambers.

It is useful that the by-pass manifold be made in the form of a pipeline, one end of which would communicate with the combustion chamber via a port made in the head of the cylinder, the other end communicating with the first and second intake chambers.

It is advantageous that the by-pass manifold be provided with cooling means.

It is useful that the by-pass manifold be provided with heating means.

It is advantageous that the engine comprise a relief valve arranged on the by-pass manifold.

It is advisable that the main and additional pistons be rigidly connected to each other by means of a rod and that the by-ass manifold contain channels made in the rod and in the bodies of the main and additional pistons and communicating with each other, wherein the valve at the outlet from the first intake chamber would be mounted in the channel made in the body of the main piston, the valve at the outlet from the second intake chamber would be mounted in the channel made in the body of the additional piston, and the valve mounted in the by-pass manifold at the inlet to the combustion chamber would be arranged in the body of the main piston.

It is useful that the valves mounted at the inlet and outlet of the first and second intake chambers be made in the form of a removable unit positioned on the outer wall of the cylinder.

It is advantageous that a spark plug be mounted in the head of the cylinder.

It is useful that the engine comprise a nozzle for injecting fuel, mounted in the head of the cylinder.

It is also useful that the engine comprise a nozzle for injecting fuel, mounted in the by-pass manifold.

It is advisable that the intake manifold comprise two channels, one of which would communicate with the first intake chamber by means of the aforesaid valve mounted in the partition at the inlet to the first intake chamber, while the other channel would communicate with the second intake chamber by means of the aforesaid valve mounted in the partition at the inlet to the second intake chamber.

It is advantageous that the by-pass manifold comprise two channels, one of which would communicate with the first intake chamber by means of the aforesaid valve mounted in the partition at the outlet from the first intake chamber, and with the combustion chamber by means of the aforesaid valve mounted at the inlet to the combustion chamber, while the other channel would communicate with the second intake chamber by means of the aforesaid valve mounted in the partition at the outlet from the second intake chamber, wherein there would be an additional valve mounted at the inlet to the combustion chamber by means of which the second channel of the by-pass manifold would communicate with the combustion chamber.

BRIEF DESCRIPTION OF THE DRAWINGS

The invention will be explained below by concrete embodiments of its realization with reference to accompanying drawings, wherein.

EMBODIMENTS OF THE INVENTION

Figure 2:
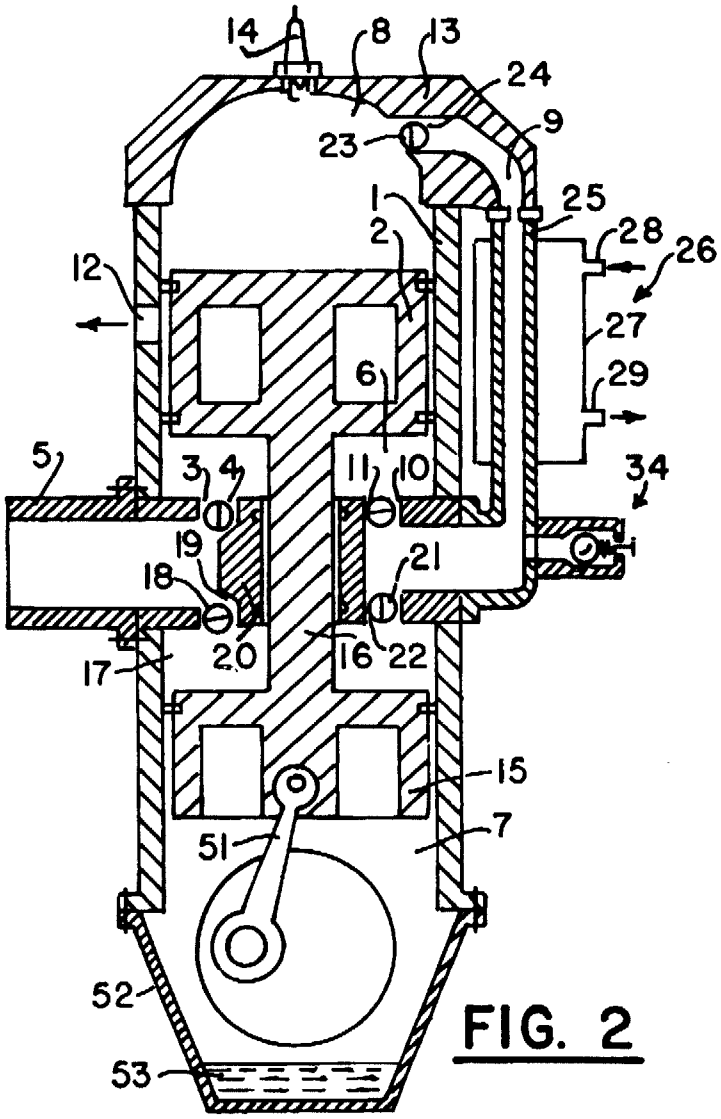
FIG. 2 shows the same as in FIG. 1, but with the by-pass manifold in the form of a pipeline (longitudinal section), in accordance with the invention.

A two-cycle internal combustion engine comprises a cylinder 1 (FIG. 1) with a piston 2. A port 3 is made in the middle part of cylinder 1. An intake valve 4 is placed in the port 3 for the ingress of a fuel-air mixture from an intake manifold 5 into an intake chamber 6. The chamber 6 is positioned under the piston 2 and is isolated from crank chamber 7.

A combustion chamber 8 is positioned above the piston 2. The chamber 8 communicates with the intake chamber 6 by means of a by-pass manifold 9. An intake valve 11 for feeding the fuel-air mixture from chamber 6 into chamber 8 is positioned at the inlet 10 of manifold 9.

A window 12 for discharging exhaust gases from the combustion chamber 8 is positioned on the wall of cylinder 1.

The engine comprises a cylinder head 13 in which a spark plug 14 is mounted.

The engine also comprises an additional piston 15 positioned in the cylinder 1 between the crank chamber 7 and the main piston 2 and rigidly connected thereto by means of a rod 16.

A second intake chamber 17, isolated from the first chamber 6, is positioned between the first intake chamber 6 and the additional piston 15. The chamber 17 communicates with the intake manifold 5 by means of a valve 18 with its input facing the intake manifold 5 and mounted in a port 19 made in a partition 20 separating the chambers 6 and 17. The valves 4, 11 in the variant being described are mounted in the partition 20 in ports. The chamber 17 also communicates with the by-pass manifold 9 by means of a valve 21 with its input facing the second intake chamber 17 and mounted in a port 22 made in the partition 20.

A valve 23 with its input facing the intake chamber 17 is mounted in the by-pass manifold 9 at the inlet into the combustion chamber 8.

In the variant being described the by-pass manifold 9 is made in the form of a channel which passes in the wall of cylinder 1 and in the head 13 of the cylinder. The channel communicates with the combustion chamber 8 via a port 24 made in the head 13 of the cylinder and with the intake chambers 6, 17.

Another variant is also possible where the by-pass manifold 9 (FIG. 2) is made in the form of a pipeline 25 positioned adjacent the side wall of the cylinder 1. The pipeline 25 is provided with cooling means 26. In the variant being described the means 26 is a jacket 27 with inlet 28 and outlet 29 pipelines for supplying a cooling agent.

The pipeline 25 communicates with the combustion chamber and with the first and second intake chambers 6, 17.

Figure 3:
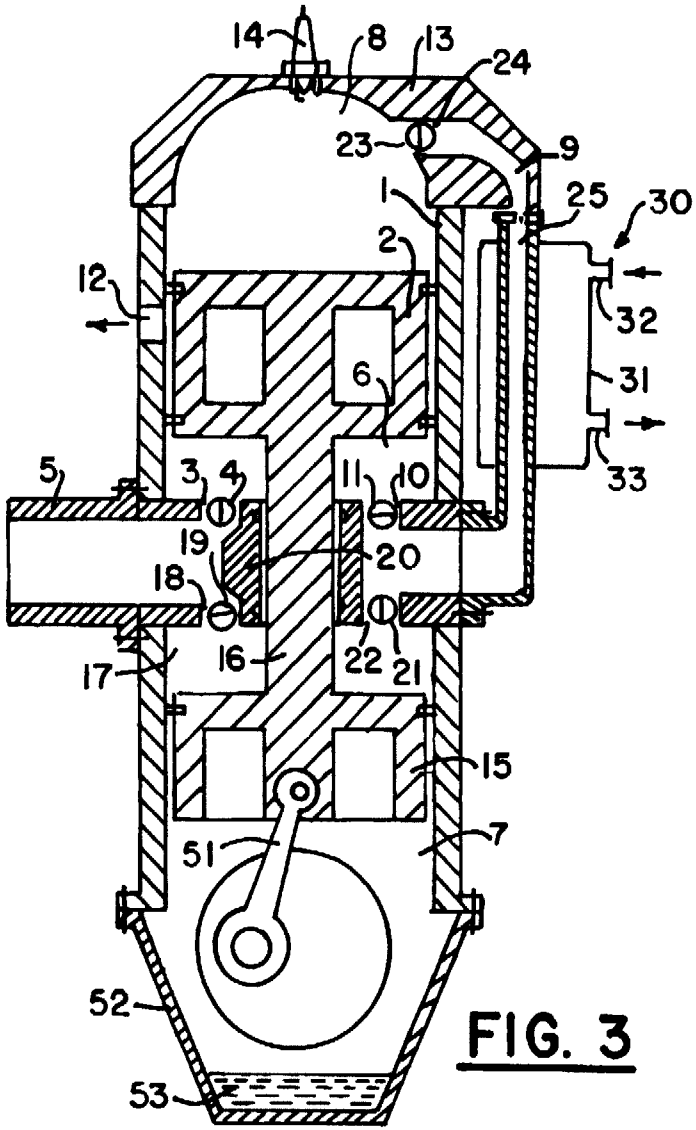
FIG. 3 shows schematically the by-pass manifold of a two-cycle engine, provided with heating means (longitudinal section), in accordance with the invention.

The pipeline 25 may be provided with a heating means 30 (FIG. 3). In this case the means 30 comprises a jacket 31 with inlet 32 and outlet 33 pipelines.

A relief valve 34 (FIG. 2) may be mounted on the by-pass manifold 9 for protection of the manifold against destruction.

Figure 4:
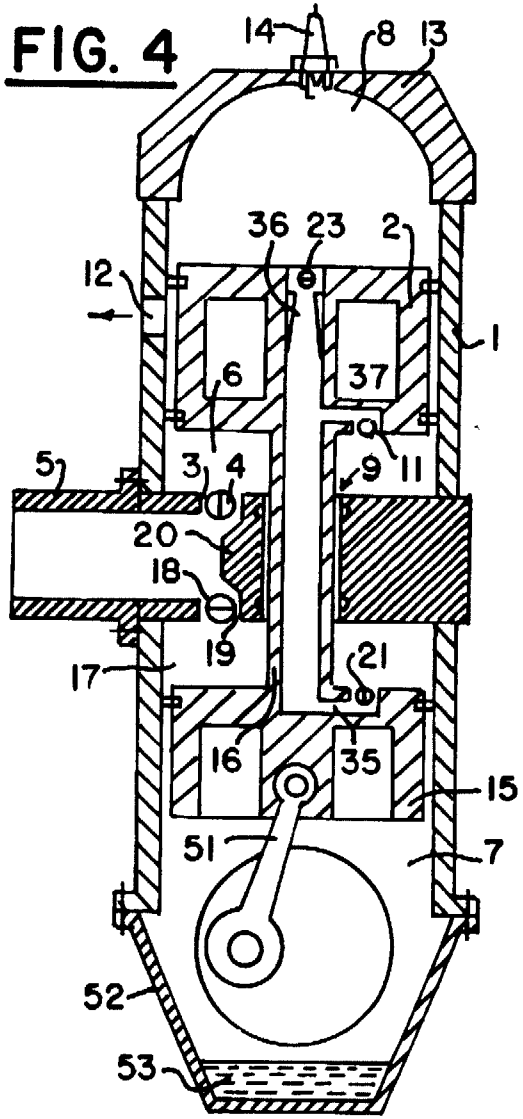
FIG. 4 shows the same as in FIG. 1, but with channels for mounting valves made in the rod and in the pistons, in accordance with the invention.

Another embodiment is possible where the main and additional pistons 2, 15 (FIG. 4) are rigidly connected to each other by means of the rod 16. Channels 35, 36, 37 are made respectively in that rod 16 and in the pistons 2, 15. These channels communicate with each other and form the by-pass manifold 9. Wherein, the valve 11 at the outlet from the first intake chamber 6 is mounted in channel 37 made in the body of the main piston 2. The valve 21 at the outlet from the second intake chamber 17 is mounted in the channel 35 made in the body of the additional piston 15. And the valve 23 mounted at the inlet to the combustion chamber 8 is placed in the channel 36 in the body of the main piston 2.

Figure 5:
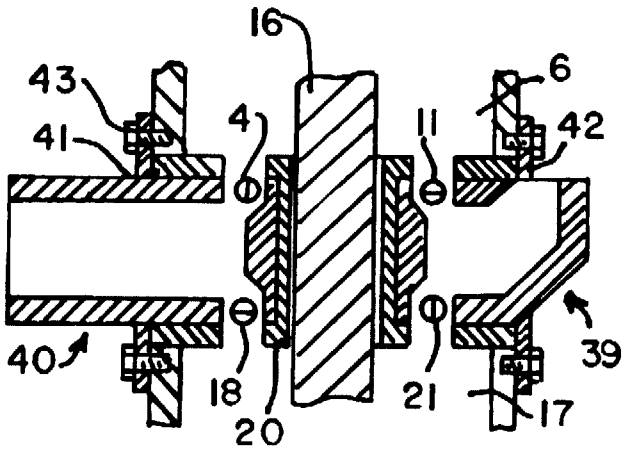
FIG. 5 shows schematically the positioning of valves in a removable unit (longitudinal section), in accordance with the invention.

A variant is possible wherein the valves 4 (FIG. 5), 18, 11, 21, mounted at the inlet and outlet of the first and second intake chambers 6, 17 are made in the form of a removable unit 38.

The unit 38 consists of several parts 39, 40, which for convenience of servicing can be inserted into corresponding ports 41, 42 in the partition 20. The parts 39, 40 are secured to the partition 20, either by means of a bolt connection 43 or by means of a catch (not shown in FIG. 5).

In the case where the fuel mixture is fed into the combustion chamber 8 via the valve 23, the two-cycle engine comprises a spark plug 14 mounted in the head 13.

A variant is possible wherein the fuel is fed into the chamber 8 (FIG. 6) via a special nozzle 44 mounted in the head 13. Wherein there may be no spark plug 14. In that case compressed air is fed into the chamber 8 via the valve 23.

A variant is possible wherein the intake manifold 5 is divided by a partition 45 and comprises two channels 46, 47. The channel 47 communicates with the first intake chamber 6 via the valve 4, while the channel 46 communicates with the second intake chamber 17 via the valve 18.

Air may be fed through one of the channels or through both channels 46, 47. In the case wherein the air is fed through one of the channels, e.g. 46, the fuel mixture may be fed through the other channel 47.

Figure 7:
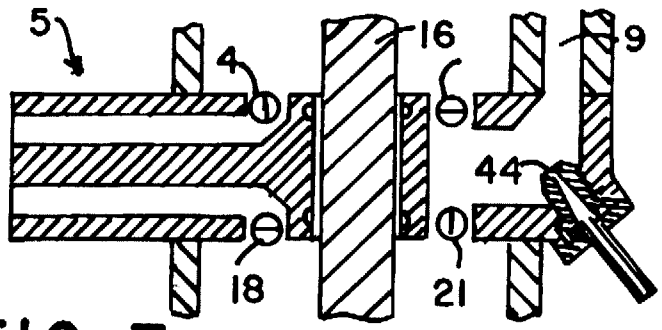
FIG. 7 shows schematically a nozzle mounted in the by-pass manifold (longitudinal section), in accordance with the invention.

The nozzle 44 may be mounted in the by-pass manifold 9 (FIG. 7).

Figure 8:
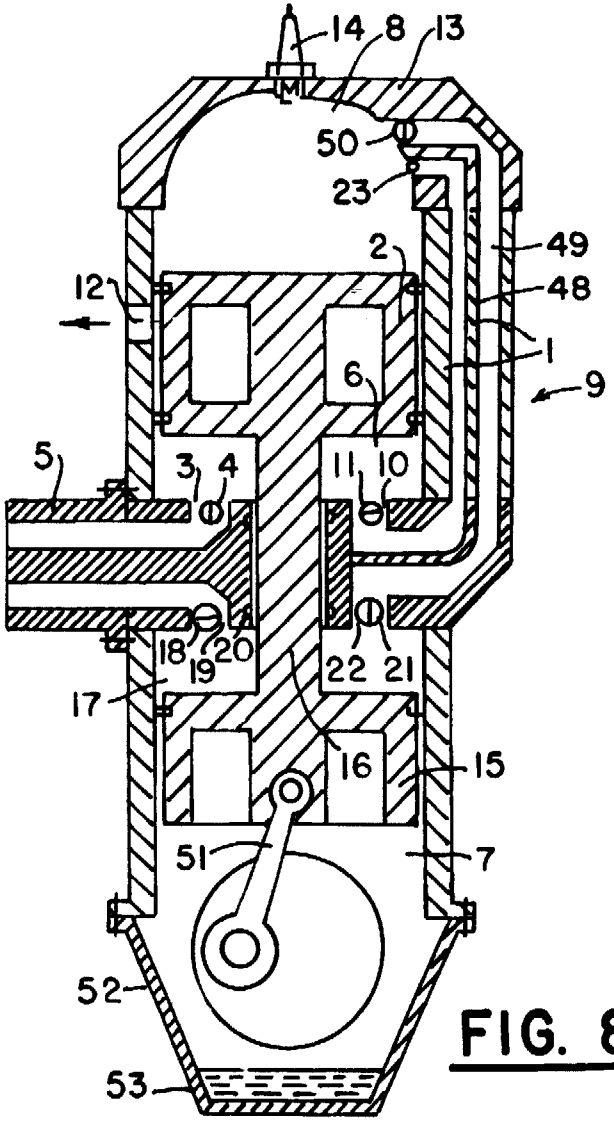
FIG. 8 shows the same as in FIG. 1, but for the case where the intake and by-pass manifolds comprise two channels, in accordance with the invention.

A variant is possible wherein the by-pass manifold 9 (FIG. 8) comprises two channels 48, 49. The channel 48 communicates with the first intake chamber 6 by means of the valve 11 and with the combustion chamber 8 by means of the valve 23. The channel 49 communicates with the second chamber 17 by means of the valve 21 and with the combustion chamber 8 by means of an additional valve 50 mounted at the inlet to the combustion chamber 8.

Figure 1:
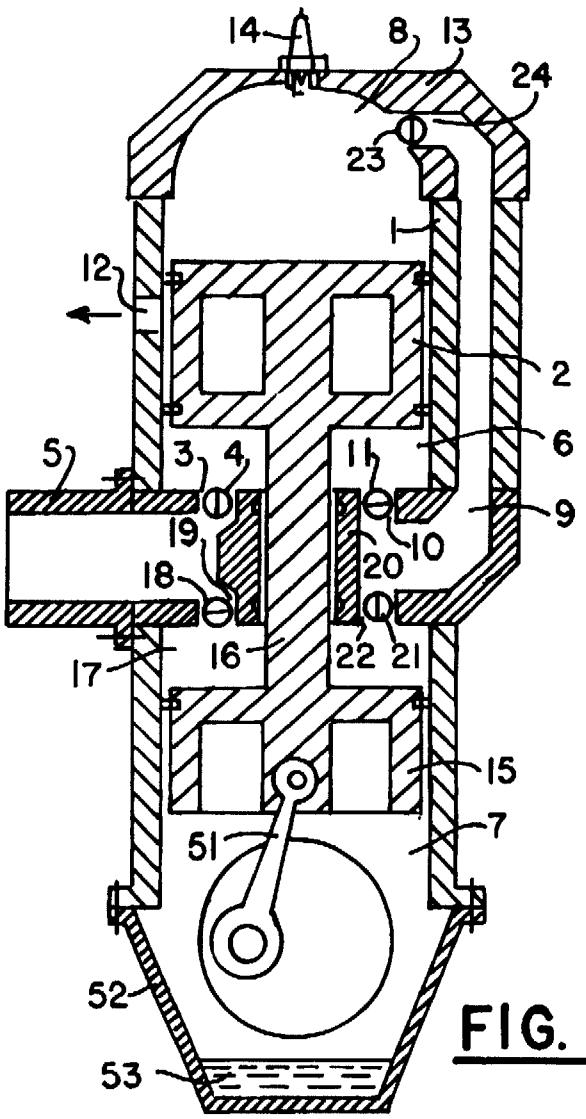
FIG. 1 shows schematically a two-cycle internal combustion engine (longitudinal section), in accordance with the invention.

A crank mechanism 51 installed in engine crankcase 52 is also shown in FIG. 1. There is oil 53 for lubrication and an oil pump (not shown in FIG. 7) in the crankcase. The lubrication system is not shown in the drawings.

Figure 9:
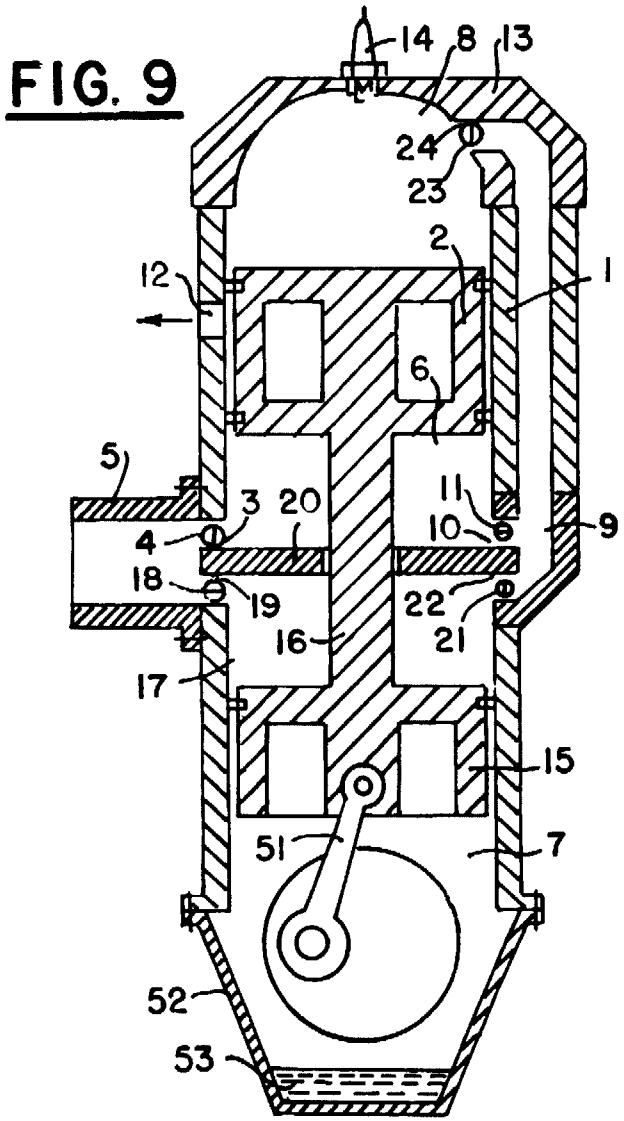
FIG. 9 shows the same as in FIG. 1, but for the case where the intake and exhaust ports are positioned on the side wall of the cylinder, in accordance with the invention.

A variant is possible wherein the ports 3 (FIG. 9), 19, 22, 10 are made in the middle part of the side surface of cylinder 1.

The internal combustion engine operates in the following manner.

Beginning of the compression stroke.

After the lower dead center the piston 2 (FIG. 1) moves upwards. The exhaust window 12 is closed and the piston 2 compresses the fuel mixture which is in the combustion chamber 8 of the cylinder 1. Simultaneously, the fuel mixture in the second intake chamber 17 is compressed. Wherewith the valve opens and the fuel mixture from the intake manifold 5 enters the first intake chamber 6.

End of the compression stroke.

The piston 2 continues to move upwards. Simultaneously the fuel mixture compressed in the second chamber 17 by the additional piston 15 enters the combustion chamber 8 via valves 21 and 23. At the end of the compression stroke the fuel mixture is exploded by an electric spark from the spark plug 14.

Power stroke.

After the electric spark the piston 2 passes through the upper dead center and begins to move downwards. Wherewith the fuel mixture which is in the chamber 6 is compressed, since the intake valve 4 is closed, while the intake valve 11 and valve 23 are closed by the high-pressure in the combustion chamber 8. Simultaneously with movement of the piston 15 downwards a fuel mixture from the intake manifold 5 is sucked into the chamber 17 via the valve 18, since the valve 21 is closed.

Scavenging.

The piston 2 moves down. Before it reaches the lower dead center the piston 2 opens the exhaust port 12 in the wall of cylinder 1. Exhaust gases exit from the port 12 and the pressure in the combustion chamber 8 rapidly falls. The valves, 23 open, the fuel mixture enters the chamber 8 from the chamber 6 via the manifold 9 and blow through, forcing out the exhaust fuel mixture.

When the piston 2 and rigidly connected thereto piston 15 are in the lower dead center, the combustion chamber 8 is scavenged, the chamber 6 is compressed and empty, while the chamber 17 is filled with the fuel mixture.

The pistons 2, 15 move upwards and a new compression stroke begins.

As the piston 2 moves upwards it closes the port 12 and all the fuel mixture supplied from the chamber 6 remains in the chamber 8. The fuel mixture from the chamber 17 is added to this fuel mixture.

This is, the amount of the fuel mixture in the combustion chamber 8 doubles, which makes it possible to increase the specific power of the engine.

Operation in the two-cycle mode makes it possible to increase the power and torque by 1.5 to 2 times.

Figure 6:
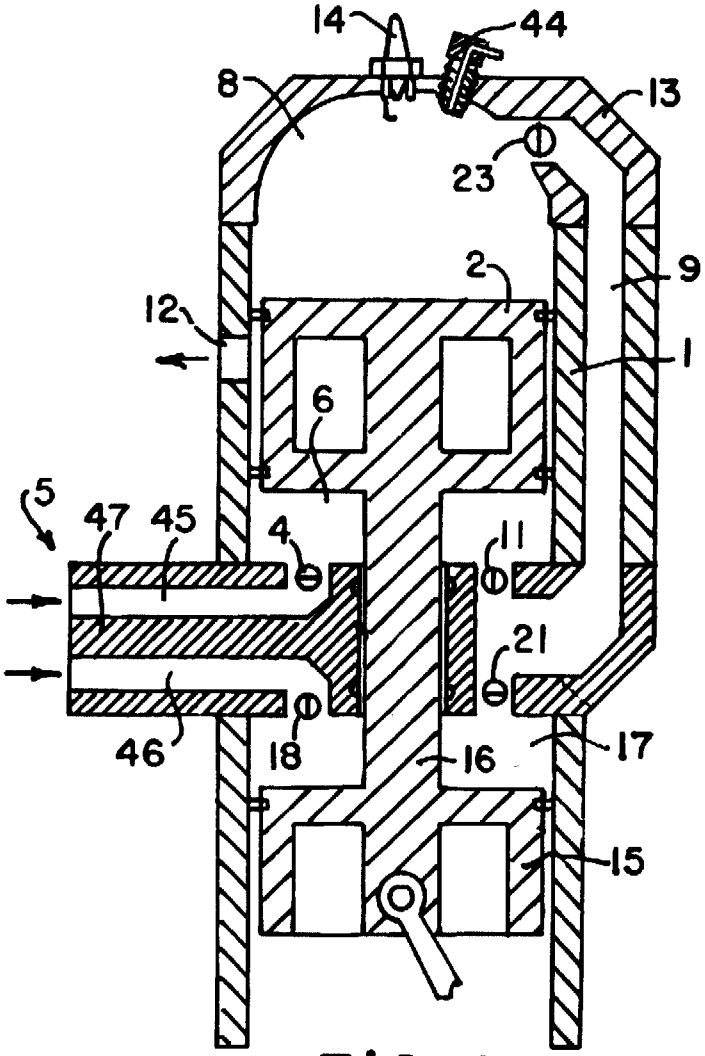
FIG. 6 shows the same as in FIG. 1, but with a nozzle mounted in the combustion chamber, in accordance with the invention.

In the case wherein air is fed through the manifold 5 the air is compressed. In that case diesel fuel is fed into the chamber 8 via the nozzle 43 (FIG. 6).

Industrial Applicability

The two-cycle internal combustion engine can be installed in automobiles, flying vehicles and also in agricultural machines—plows, minitractors, gasoline powered saws, ships, diesel locomotives.

This engine is easy to service, more ecologically clean, with smaller size has greater power as compared with prior art.

I claim:

1. A two-cycle internal combustion engine comprising a cylinder with a main piston, the cylinder having a port in which an intake valve is placed for feeding a fuel-air mixture from an intake manifold into a first intake chamber which is positioned under the piston, is isolated from a crank chamber and communicates with a combustion chamber positioned above the piston by means of a by-pass manifold, with an intake valve placed at the input of the by-pass manifold for feeding the fuel-air mixture from the intake chamber into the combustion chamber, a window for discharging exhaust gases from the combustion chamber, the window being positioned on the wall of the cylinder, characterized in that the engine comprises an additional piston arranged in the cylinder between the crank chamber and the main piston and rigidly connected to the main piston, a second intake chamber which is positioned between the first intake chamber and the additional piston, is isolated from the first intake chamber by means of a partition and communicates with the intake manifold by means of a valve mounted in a port at the inlet to the second intake chamber and facing with its input the intake manifold, and with the by-pass manifold by means of a valve mounted in a port at the outlet from the second intake chamber and facing with its input the second intake chamber, and a valve mounted in the by-pass manifold at the inlet to the combustion chamber and facing with its input the first and second intake chambers, said inlet being at a level allowing fuel introduction into the combustion chamber during the compression stroke.

2. A two-cycle engine according to claim 1, characterized in that the by-pass manifold is made in the form of a channel in the wall of the cylinder and in a head of the cylinder, one end of which communicates with the combustion chamber via a port made in the head of the cylinder, the other end communicating with the first and second intake chambers.

3. A two-cycle engine according to claim 1, characterized in that the by-pass manifold is made in the form of a pipeline, one end of which communicates with the combustion chamber via a port made in the head of the cylinder, the other end communicating with the first and second intake chambers.

4. A two-cycle engine according to claim 3, characterized in that the by-pass manifold is provided with cooling means.

5. A two-cycle engine according to claim 3, characterized in that the by-pass manifold is provided with heating means.

6. A two-cycle engine according to claim 3, characterized in that it comprises a relief valve mounted on the by-pass manifold.

7. A two-cycle engine according to claim 1, characterized in that the main and additional pistons are rigidly connected to each other by means of a rod, and the by-pass manifold comprises channels made in the rod and in bodies of the main and additional pistons and communicating with each other, wherein the valve at the outlet from the first intake chamber is mounted in the channel made in the body of the main piston, the valve at the outlet from the second intake chamber is mounted in the channel made in the body of the additional piston, while the valve mounted in the by-pass manifold at the inlet to the combustion chamber is arranged in the body of the main piston.

8. A two-cycle engine according to claim 1, characterized in that the valves mounted at the inlet and outlet of the first and second intake chambers are made in the form of a removable unit positioned on the outer wall of the cylinder.

9. A two-cycle engine according to claim 1, characterized in that a spark plug is mounted in the head of the cylinder.

10. A two-cycle engine according to claim 1, characterized in that it comprises a nozzle for injecting fuel which is mounted in the head of the cylinder.

11. A two-cycle engine according to claim 9, characterized in that it comprises a nozzle for injecting fuel which is mounted in the by-pass manifold.

12. A two-cycle engine according to claim 1, characterized in that the intake manifold comprises two channels, one of which communicates with the first intake chamber by means of said valve mounted in the partition at the inlet to the first intake chamber, while the other channel communicates with the second intake chamber by means of said valve mounted in the partition at the inlet to the second intake chamber.

13. A two-cycle engine according to claim 1, characterized in that the by-pass manifold comprises two channels, one of which communicates with the first intake chamber by means of the valve mounted at the outlet from the first intake chamber and with the combustion chamber by means of the valve mounted at the inlet into the combustion chamber, while the other channel communicates with the second intake chamber by means of the valve mounted at the outlet from the second intake chamber, wherein an additional valve is provided which is mounted at the inlet to the combustion chamber, by means of which additional valve the second channel of the by-pass manifold communicates with the combustion chamber.

* * * * *

UNITED STATES PATENT AND TRADEMARK OFFICE

CERTIFICATE OF CORRECTION

PATENT NO. : 5,791,303
DATED : August 11, 1998
INVENTOR(S) : Jury N. Skripov

It is certified that error appears in the above-identified patent and that said Letters Patent is hereby corrected as shown below:

Title page, change item [22] to read --PCT Filed: July 12, 1995--.
Add the following items:

--[86] PCT No. : PCT/ RU95/ 00148

371 Date: January 10, 1997

102(e) Date: January 10, 1997--

--[87] PCT Pub. No. : WO96/ 02744

PCT Pub Date : February 1, 1996--

Signed and Sealed this
Fifth Day of December, 2000

*Attest:*

*Attesting Officer*

Q. TODD DICKINSON

*Director of Patents and Trademarks*